US005327828A

United States Patent [19]

Barocas et al.

[11] Patent Number: 5,327,828

[45] Date of Patent: Jul. 12, 1994

[54] CLAMP AND PROCESS FOR PROTECTING PRINTING SCREENS AND FRAMES

[76] Inventors: Ervin V. Barocas, 1197 Ragley Hall Rd., Atlanta, Ga. 30319; Lewis C. McLemore, III, 702 Park St., Port Barre, La. 70577

[21] Appl. No.: 11,171

[22] Filed: Jan. 29, 1993

Related U.S. Application Data

[63] Continuation-in-part of Ser. No. 761,305, Sep. 17, 1991, abandoned.

[51] Int. Cl.[5] ..... B41L 13/02; B05C 17/08

[52] U.S. Cl. ..... 101/127.1; 101/127; 101/128.4

[58] Field of Search ..... 101/127–128.4

[56] References Cited

U.S. PATENT DOCUMENTS

| | | | |
|---|---|---|---|
| 1,742,339 | 1/1930 | Borregard | 101/127.1 |
| 1,874,476 | 8/1932 | Elliot | 101/127.1 |
| 2,218,451 | 10/1940 | Heyue | 101/127.1 |
| 2,299,628 | 10/1942 | Johnson et al. | 101/127.1 |
| 3,859,918 | 1/1975 | Dargols | 101/127.1 |
| 4,860,814 | 8/1989 | Vilmann et al. | 38/102 |
| 4,863,156 | 9/1989 | Shaw | 482/27 |
| 4,934,738 | 6/1990 | Colonna | 402/73 |

*Primary Examiner*—Edgar S. Burr
*Assistant Examiner*—Lynn D. Hendrickson
*Attorney, Agent, or Firm*—Thomas W. Tolpin

[57] ABSTRACT

An attractive, economical, dependable frame protector and process are provided to minimize tearing, puncturing, scratching, and loosening of printing screens as well as to protect and extend the useful life of a printing screen frame. The frame protector comprises a special expandable clamp with an annular body portion and lips which clamp the printing screen. The lips of the clamp can be taped to the printing screen. The clamp annularly surrounds and covers the frame member. The annular body portion includes a printing screen frame-engagable clamping member with a bight that is shaped and arranged to complement the contour of and clamp a frame member of a printing screen frame.

18 Claims, 1 Drawing Sheet

CLAMP AND PROCESS FOR PROTECTING PRINTING SCREENS AND FRAMES

RELATED APPLICATION

This application is a continuation-in-part of the patent application of Ervin V. Barocas and Lewis C. McLemore III for a Silk Screen Frame Assembly, Ser. No. 07/761,305, filed Sep. 17, 1991, now abandoned.

BACKGROUND OF THE INVENTION

This invention relates to screen printing and more particularly to a clamp and process for protecting printing screens and frames.

Screen printing has been used to print designs on mugs, cups, dishes, shirts, and other textiles and products for years. Screen printing can be accomplished with printing screens made of such silk, polyester, and fine mesh metal. The negative of the image to be printed is placed on the printing screen so that when ink flows through the screen only the desired image, pattern, illustration and/or words will be printed.

The printing screen is usually held in place by a rigid frame, such as a rectangular frame. It is important that the screen be held in place with the proper amount of tension against the frame to attain sharp accurate printing.

Printing screens and frames can be used for high volume printing and are regularly moved, assembled and disassembled. They are frequently bumped, knocked, thrown around, dropped, abused, mishandled and subject to rigorous tension, torsion, and compressive forces. As a result, printing screens often tear, puncture, fray or are scratched and printing frames are often damaged. Printing screens usually tear near the edges of the screens in closed proximity to the printing frame. Damaged printing frames can result in undesired loosening, twisting, or stretching of printing screens.

Damaged printing frames and torn printing screens often result in blurred printing, blotches, misalignment of colored images, undesired extraneous lines and ink markings, ruined prints, waste, and printed products of unacceptable quality. Substantial costs are incurred in print wastage, reprinting, replacing torn, frayed, or scratched printing screens, correcting loosened or twisted printing screens, and repairing or replacing damaged printing frames.

Over the years a variety of printing screens, frames and other equipment have been suggested. Typifying these printing screens, frames and other equipment are those shown in U.S. Pat. Nos.: 1,742,339; 1,874,476; 2,218,451; 2,299,628; 2,566,919; 2,693,205; 3,230,882; 3,273,497; 3,757,953; 3,859,918; 4,568,455; 4,863,156; 4,860,814; and 4,934,738. These printing screens, frames, and other equipment have met with varying degrees of success but have not been satisfactory to prevent tearing, fraying, and scratching of printing screens nor to prevent damage to printing frames.

It is, therefore, desirable to provide an improved apparatus and process which overcomes most, if not all, of the preceding problems.

SUMMARY OF THE INVENTION

An improved frame protector assembly, clamp and process are provided to substantially prevent tearing, puncturing, fraying, and scratching of printing screens and damage to printing screen frames. Desirably, the improved frame protector assembly, clamp and process help protect and extend the useful life of printing screens and printing frames. Advantageously, the inventive frame protector assembly, clamp and process are economical, reliable, easy to use, simple to install, durable, efficient, and effective.

To this end, the novel frame protector comprises an expandable clamp which can peripherally and annularly surround and substantially enclose the entire frame member of a printing screen frame. Desirably, the clamp can extend substantially along the entire length of the frame member. The inventive clamp preferably has an annular body portion comprising a special printing screen frame-engageable clamping member. The special clamping member has a resilient impact-resistant bight portion which can extend at least about 270 degrees and is shaped complementary to a portion of the contour of the frame member so that the clamp can readily matingly engage the frame member. The clamps and contour (cross section) of the frame members can be rounded, circular, rectangular, or of other shapes.

When installed, the clamping member is in a normally closed biased position ito clamp and compressively engage the frame member. The clamping member and mouth can be expanded and opened to remove the clamping member from the frame or to insert the clamp about the frame.

Symmetrical longitudinal and lateral frame protectors can be installed on the printing screen frame. The clamping members of the lateral frame protectors can have laterally extending ears with rounded corners positioned adjacent the lateral frame members for enhanced protection and rigidity. The clamp can have parallel flanges which provide screen-engageable lips that extend inwardly from the clamping member to engage and clamp the printing screen. The inventive clamp can be extruded for economy of manufacture, mass production and improved quality.

In one embodiment, the clamping member has an arcuate bight portion and V-shaped leg portions. The V-shaped leg portions extend between and are connected to the lips and bight portion. In another embodiment, the clamping member has a rectangular bight portion.

Polyvinyl chloride (PVC) clamps are particularly useful frame protectors. In some circumstances it may be desirable that the frame protectors be made of metal, wood, rubber, composite plastics, themosetting resins, elastomeric thermoplastics, or other plastics, such as: polyurethane, polyethylene, polyethylene oxide, polycarbonate, polyethylene, polypropylene, olefins (polyolefins), polyamides, (nylon), polyamide-imides, polyimide sulfones, styrenes including styrene/acrylonitrile (SAN), styrene/butadiene (SB), styrene/maleic anyhydryde, vinyls including polyvinyl acetal, polyvinyl acetate (PVAC), polyvinyl alcohol (PVAL), polyvinyl butyral (PVB), polyvinyl carbozole (PVK), polyvinylpyrrolidone (PVP), polyvinyl chloride acetate (PVCA), polyvinyl fluoride (PVF), polyvinylidene chloride PVDC), and ethylene/ethyl acrylate (EEA), acrylonitrile/butadiene/styrene (ABS), acrylonitrile/-styrene/acrylate (ASA), acetal (polyformaldehyde), acetate, ethylene/vinyl acetate (EVA), acrylic (polymethyl methacrylate), acrylonitrile/methyl/methacrylate (AMMA), polyoxymethylene, butyrate, cellulosics including cellulose nitrate (CN), cellulose propionate (CP), ethyl cellulose (EC), cellulose acetate (CA), cellulose acetate butyrate (CAB), cellulose acetate propionate (CAP), cellulose formaldehyde (CF), cellulose triacetate (CTA), polyethylene terephthalate (PET), flouropolymers including chlorinated polyethylene (CPE), chlorinated polyvinyl chloride (CPVC), ionomers, polyarylate, polyarylterephthalate (PAT), polyarylether (PAE), polyarylamid (polyaramide), polyarylsulfone, polyphthalamide, polyarylsulfone, polybutylene, polyester, ethylene, polyuryletherketone, polymethylpentane, polyphenylene sulfide, polyphtralamide, or polysulfone, or combinations or blends of two or more of the preceding.

The clamps can be coated or made with polytetrafluorethylene (PTFE) or other hydrophobic water-impermeable, liquid-impervious, ink-resistant materials.

The clamp can be light transmissive, i.e. transparent or translucent or can be opaque. The clamp can have a visual indicator or can be molded of a particular color plastic to correspond and identify a specific size frame or frame member.

In the inventive screen printing process, the printing screen is substantially prevented from being torn and the useful life of the printing screen frame is extended by annularly surrounding, enveloping, and covering the frame members of the printing screen frame with elongated annular clamps, preferably the inventive clamps described above. In the process, the edges of the printing screen are clamped with the lips of the clamp. Thereafter, the lips of the clamps and the edges of the printing screen are taped. In the preferred process, such taping included placing masking tape along the entire edges of the printing screen and lips of the clamps. In some circumstances, it may be desirable to use other types of tape.

In the preferred process, during installation, the lips of the clamps are expanded and the mouths of the clamps are opened to span a greater distance than the maximum thickness of the frame members. The clamps are then inserted on the frame member. Once inserted and installed in the proper position, the lips of the clamps are contracted and the mouths of the clamps are closed about the frame members. The clamps can snap fit, clamp, lockably engage or slide onto the frame members.

A more detailed explanation of the invention is provided in the following description and claims taken in conjunction with the accompanying drawing.

DETAILED DESCRIPTION OF THE PREFERRED EMBODIMENTS

Figure 1:
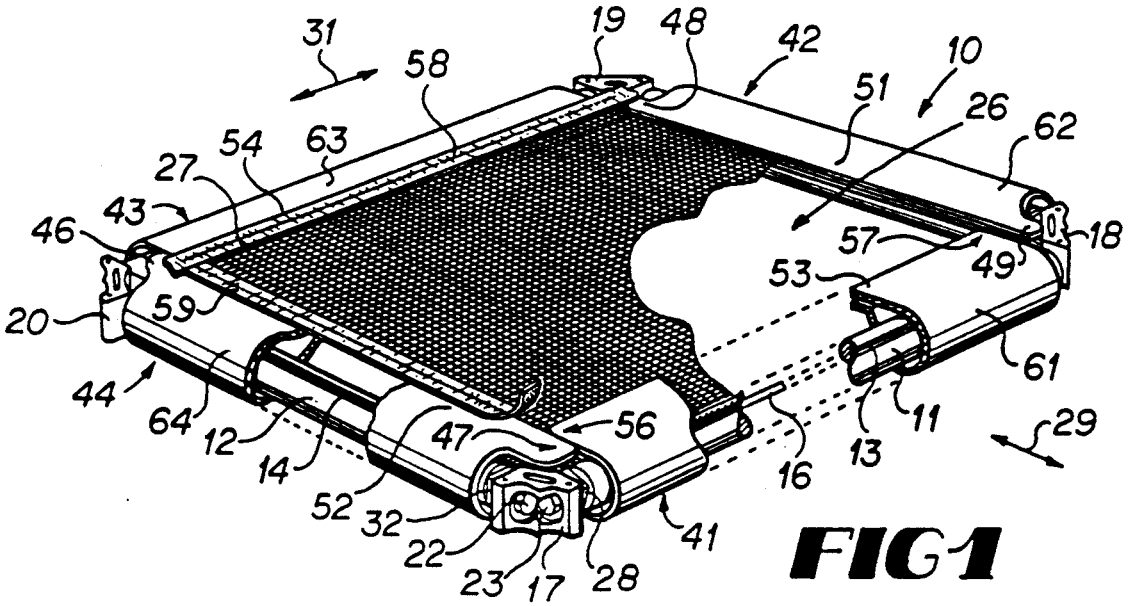
FIG. 1 is a bottom perspective view of a frame protector assembly installed on a printing screen and frame in accordance with principles of the present invention with portions cut away for ease of understanding and clarity.

Referring to FIG. 1 of the drawings, a rectangular printing screen frame 10, such as a silk screen frame assembly, has elongated longitudinal and lateral symmetrical frame members 11 and 12. The frame members 11 and 12 can be made of metal, wood or plastic. The frame members 11 and 12 can comprise rollers with slots 13 and 14 formed therein to receive an elongated securing strip or card 16. Tensioning end brackets 17–20 are secured to the frame members by locking bolts 22 and 23.

The end brackets 17–20 and the elongated frame members 11 and 12 of the rectangular frame assembly 10 (framework) peripherally surround a rectangular opening 26. A fine mesh silk printing screen 27 is secured to the edges of the elongated frame members 11 and 12 and covers the opening 26. In some circumstances, it may be desirable to use a printing screen made of polyester, other fibrous printing screen material, or fine mesh woven metal. The printing screen 27 can secured to the elongated frame members 11 and 12 by looping a section of the printing screen 27 into the recesses or slots 13 and 14 in the frame members 11 and 12 and sliding the card 16 into the slots 13 and 14 to securely hold and wedge the screen within the slots 13 and 14. The printing screen 27 can be spread, pulled and tightened to the desired tension and flatness by turning or rotating the elongated cylindrical frame members 11 and 12. This can be accomplished by loosening lock bolts 22 and 23 with a wrench or other suitable tool, adjacent wrench flats 28 and 31 and rotating or turning the frame members 11 and 12 in outward directions until the desired tension is attained, and thereafter tightening and securing the bolts 22 and 23 in a locked position. Tightening can be done sequentially on the longitudinal and lateral frame members 11 and 12.

In order to protect the edges of the printing screen 27 and help prevent the printing screen from being torn, punctured, scratched and frayed, as well as to enhance the longevity and useful life of the frame members 11 and 12 and help protect the frame assembly 10 from being damaged, the frame members 11 and 12 are annularly surrounded, enveloped, and covered with frame protectors 41–44. The frame protectors include longitudinal, symmetrical, parallel, elongated frame protectors 41 and 43 and lateral, symmetrical, parallel, elongated frame protectors 42 and 44. The longitudinal frame protectors 41 and 43 extend longitudinally between and are connected adjacent the lateral frame protectors 42 and 44. The lateral frame protectors 42 and 44 extend laterally between and are connected adjacent to the longitudinal frame protectors 41 and 43.

Each of the frame protectors 41–44 comprise an expandable elongated clamp made of impact-resistant plastic. The clamps 41–44 provide protective covers and are of a length to extend and cover the entire span and length of the elongated frame members 11 and 12.

The clamps 41–44 are securely fitted about the frame members 11 and 12 to protect the printing screen 27 in the vicinity and region where the printing screen 27 is secured to the frame members 11 and 12. Each clamp 41–44 is sized and adapted to fit along the length of the frame member 11 or 12 to which it encloses.

The lateral clamps 42 and 44 can have laterally extending ears 46–49 at their ends to partially cover the tension brackets 17–20. The ears have rounded arcuate corners to prevent scratching or damaging the printing screen 27 and other clamps 41 and 43. Clamps 41–44 can also have rounded, tapered and chamfered edges to prevent damaging the frame assembly 10 and printing screen 27.

Figure 2:
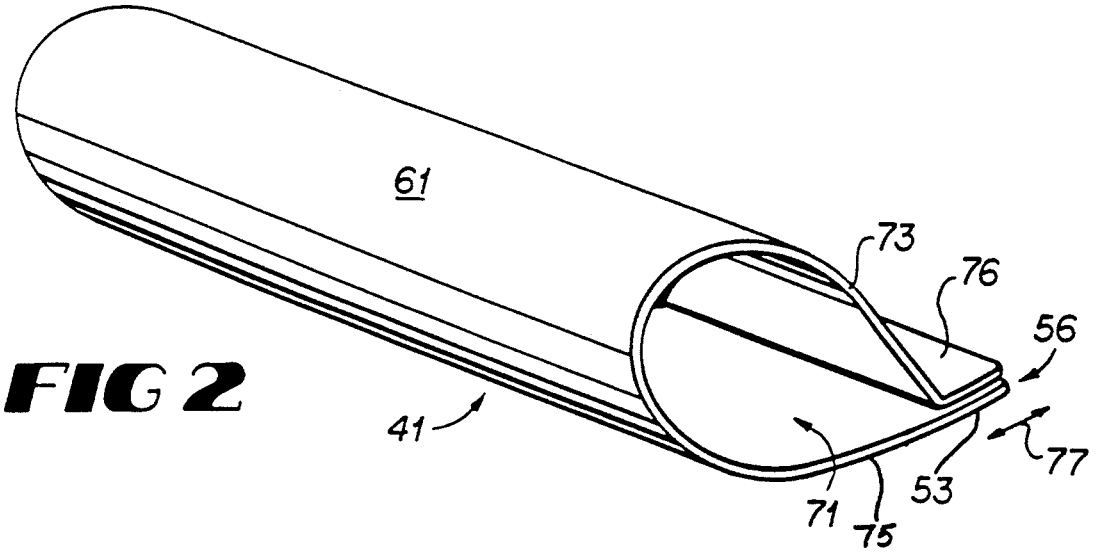
FIG. 2 is an enlarged perspective view of a frame protector.
Figure 3:
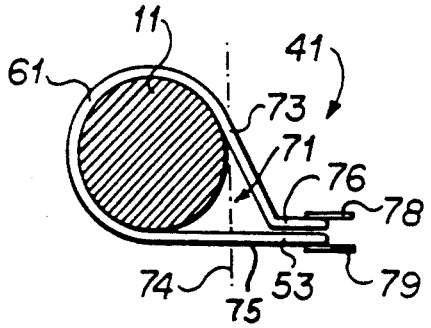
FIG. 3 is an end view of a frame protector securing the cross section of a cylindrical frame member.

Each clamp 41–44 has an annular body portion 61–64 which comprises a printing screen frame-engageable clamping member. The clamping members 61–64 of FIGS. 1–3 have an arcuate, rounded, resilient, elastomeric, flexible, impact-resistant bight or bight portion. The arcuate bight portions 61–64 extend at least about 270 degrees to define an opening or mouth 71 (FIG. 2). The inner frame member-engaging surfaces of the bight portions (bight portions) 61–64 (FIG. 1) are concave and shaped complementary to the exterior contour and shape of the frame members 11 and 12 to matingly engage and securely clamp the frame members 11 and 12.

Each clamp can have V-shaped legs or leg portions 73 and 75 (FIG. 3) which extend tangentially and integrally inwardly from the arcuate bight portion (body portion), such as from body portion 61. The mouth or opening 71 of the clamp includes the interior space between the legs 73. The clamps 41–44 have inwardly extending, normally closed, parallel, screen-engaging fingers or lips 51–54 and 76 to securely engage and clamp the edges of the printing screen 27. The lower lips 51–54 provide lower flanges which extend integrally inwardly from and in horizontal coplanar relationship with the lower leg 75. The upper lip 76 provides an upper flange which extends integrally from the upper leg 73 at an obtuse angle of 135 degrees. The legs 73 and 75 extend between and connect the lips to the arcuate bight portion (body portion). The lips 51–54 and 76 can be taped and sealed to the printing screen by water-impermeable, liquid-impervious ink-resistant tape 58 and 59 (FIG. 1) and 78 and 79 (FIG. 3), such as masking tape. The tape also seals the cover during use and cleaning.

The clamps 41–44 and clamping members 61–64 are in a normally closed, biased, contracted, clamping position when installed to annularly surround, enclose, clamp, snap fit, and interlockingly engage the frame members 11 and 12. The clamps 41–44 are expanded during installation and removal to an open, expanded position to open the mouth (opening) 71 to a greater span than the maximum diameter and cross section of the frame member 11 or 12 so as to allow the clamps to slidably receive the frame members 11 and 12 during installation and assembly and to accommodate removal of the clamps 41–44 from the frame member 11 and 12 during disassembly.

It was unexpectedly and surprisingly found that extruded polyvinyl chloride (PVC) clamps 41–44 having a specific gravity of 1.3 and a thickness of approximately 0.06 inches are particularly useful and economical to manufacture and provide high impact strength, stiffness, light weight, and low density. It some circumstances, it may be desirable to manufacture the clamps 41–44 from other materials.

The improved screen printing process of the present invention includes substantially preventing tearing of the printing screen 27 and extending the useful life of the printing screen frame 10 by annularly surrounding and covering the frame members 11 and 12 with annular clamps 41–44. The improved printing process also includes clamping and compressing the edges of the printing screen 27 with the lips 51–54 and 76 of the clamps 41–44 and, thereafter, taping the lips 51–54 and 76 of the clamps 41–44 to the edges of the printing screen 27 with tape 58, 59, 78 and 79. During installation, the lips 51–54 and 76 and mouth 71 of the clamp 41–44 are expanded and spread open to a span greater than the maximum thickness of the cross section of the frame member 11 or 12 and the clamps 41–44 are inserted on the frame member 11 or 12. After installation, the lips 51–54 and 76 and mouth 71 are contracted, closed and clamped about the frame member 11 or 12.

Figure 4:
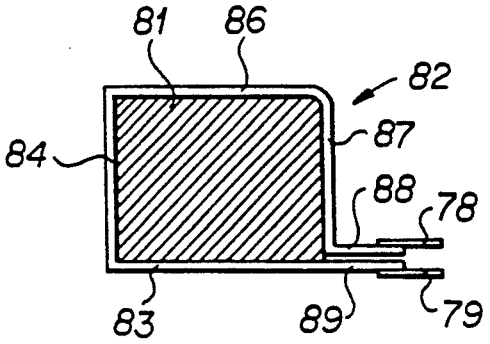
FIG. 4 is an end view of a rectangular frame protector securing the cross section of a rectangular frame member in accordance with principles of the present invention.

The rectangular frame protector 82 of FIG. 4 provides a protective cover and comprises a rectangular expandable elongated clamp. The frame protector (clamp) 82 peripherally surrounds, envelopes and encloses a rectangular elongated frame member 81. The rectangular frame protector 82 and frame member 81 are generally structurally and functionally similar to the circular or tear drop-shaped frame protectors and cylindrical frame members of FIGS. 1–3 except for their shapes. The rectangular clamp 82 has a rectangular bight or bight portion which provides a rectangular clamping member and rectangular body portion with substantially planar and flat faces 83, 84, 86 and 87. The upper lip 88 comprise an upper flange which is perpendicular to a vertical face 87 of the bight when the clamp 82 is in the normally closed clamping position about the frame member 81. The lower lip 89 comprises a lower flange which extends in coplanar relationship from the lower horizontal face 83 of the bight when the clamp 82 is in the normally closed clamping position about the rectangular frame member 81.

In use, the lips of the clamps are spread open and progressively slip over the frame members.

The invention of this application is also described in the parent application of Ervin V. Baracos and Lewis C. McLemore III for a Silk Screen Frame Assembly, Ser. No. 07/761,305, filed Sep. 17, 1991, which is hereby incorporated by reference.

Among the many advantages of the inventive frame protectors, clamps and process are:

1. Outstanding performance.
2. Superb protection.
3. Helps prevent tearing, puncturing and scratching of printing screens.
4. Avoids extensive use of split liner tape to keep ink off the edges of printing screens.
5. Minimizes printing screen damage and repair.
6. Simple to install.
7. Easy to use.
8. Can be readily mass produced.
9. Provides excellent covers for screen printing.
10. Attractive.
11. Economical.
12. Dependable.
13. Efficient.
14. Effective.

Although embodiments of the invention have been shown and described, it is to be understood that various modifications and substitutions, as well as rearrangements of parts, components, and process steps, can be made by those skilled in the art without departing from the novel spirit and scope of this invention.

What is claimed is:

1. A frame protector for protecting and extending the useful life of a printing screen frame, comprising:

an expandable clamp for peripherally surrounding, enclosing and extending along a length of a frame member of a printing screen frame;

said clamp having an annular body portion comprising a printing screen frame-engageable clamping member with a resilient bight portion extending at least about 270 degrees, said bight portion being complementary to the contour of the frame member to matingly engage the frame member, said clamping member being in a normally closed biased position for clamping and snap fitting interlocking engagement with said printing screen frame and being expandable to define a mouth for slidably receiving said frame member; and said clamp having substantially parallel flanges defining screen-engageable lips extending inwardly from said clamping member for engaging, clamping and preventing tearing of a printing screen.

2. A frame protector in accordance with claim 1 wherein said clamping member has laterally extending ears with arcuate corners.

3. A frame protector in accordance with claim 1 wherein said clamping member has an arcuate bight portion and V-shaped leg portions extending inwardly from said bight portion, and said leg portions extending between and connecting said lips to said bight portion.

4. A frame protector in accordance with claim 1 wherein said clamping members have a substantially rectangular bight portion.

5. A frame protector assembly for protecting a printing screen frame and preventing tearing of edges of a printing screen secured by the printing screen frame, comprising:

a pair of longitudinal substantially symmetrical frame protectors;

a pair of lateral substantially symmetrical frame protectors extending laterally between and connected adjacent to said longitudinal frame protectors;

each of said longitudinal and lateral frame protectors comprising an expandable elongated impact-resistant clamp for annularly surrounding, enclosing and extending along a frame member of a printing screen frame;

said clamp having an annular body portion comprising a printing screen frame-engageable clamping member with a flexible arcuate bight, said bight being complementary to the contour of the frame member to matingly engaging the frame member, said clamping member being in a normally closed biased position for clamping and compressively engaging said printing screen frame and being expandable to define a mouth for receiving said frame member;

said clamp having substantially parallel flanges defining screen-engageable lips extending inwardly from said clamping member for covering and clamping edges of a printing screen; and detachable water-impermeable tape for taping and connecting said lips to said printing screen.

6. A frame protector assembly in accordance with claim 5 where said lateral frame protectors have laterally extending ears with rounded corners.

7. A frame protector assembly in accordance with claim 5 wherein said clamps comprise colored plastic clamps.

8. A frame protector assembly in accordance with claim 5 wherein said clamping member has an arcuate bight and V-shaped leg portions extending inwardly from said bight, and said leg portions extending between and connecting said lips to said bight.

9. A frame protector assembly in accordance with claim 5 wherein said clamping members has a substantially rectangular bight.

10. A frame protector assembly in accordance with claim 5 wherein said clamps comprise polyvinyl chloride clamps having a thickness of about 0.06 inches.

11. A screen printing process, comprising the steps of:

preventing a printing screen from tearing and extending the useful life of a printing screen frame holding said printing screen by annularly surrounding and covering frame members of said printing screen frame with elongated annular clamps;

clamping edges of said printing screen with lips of said clamps; and taping the lips of said clamps to the edges of said printing screen.

12. A process in accordance with claim 11 including: expanding the lips and opening the mouth of the clamps to a span greater than the maximum thickness of said frame members; inserting said clamps on said frame members; and contracting the lips and closing the mouth of said clamps about said frame members.

13. A process in accordance with claim 11 including clamping said clamps on said frame members.

14. A process in accordance with claim 11 including snap fitting said clamps on said frame members.

15. A process in accordance with claim 11 including sliding said clamps on said frame members.

16. A process in accordance with claim 11 including lockably engaging said clamps to said frame members.

17. A process in accordance with claim 11 including covering frame members with said clamps.

18. A process in accordance with claim 11 wherein said taping comprises placing masking tape along edges of said printing screen and lips of said clamps.

* * * * *